United States Patent [19]

Fitzgerald

[11] 4,313,385

[45] Feb. 2, 1982

[54] FOLDING FURNITURE

[76] Inventor: Patrick W. Fitzgerald, 13 Third Ave., Filton, Bristol, England

[21] Appl. No.: 48,439

[22] Filed: Jun. 14, 1979

[30] Foreign Application Priority Data

Jun. 19, 1978 [GB] United Kingdom ..... 27321/78

[51] Int. Cl.[3] ..... A47C 5/04

[52] U.S. Cl. ..... 108/38; 108/39; 108/48

[58] Field of Search ..... 108/38, 39, 48, 134

[56] References Cited

U.S. PATENT DOCUMENTS

| | | | |
|---|---|---|---|
| 2,658,294 | 11/1953 | Hull | 108/48 X |
| 2,679,895 | 6/1954 | Zoercher | 297/59 |
| 2,833,608 | 5/1958 | Tobias | 108/48 X |
| 3,236,558 | 2/1966 | Kaufman | 297/59 |
| 3,696,762 | 10/1972 | Holdham | 108/48 X |
| 3,730,107 | 5/1973 | Bergkamp et al. | 108/39 |
| 3,866,547 | 2/1975 | Guyton | 108/38 |
| 4,068,551 | 1/1978 | Kreitz | 108/48 |
| 4,100,858 | 7/1978 | Bue et al. | 108/48 |

*Primary Examiner*—Francis K. Zugel

*Attorney, Agent, or Firm*—William R. Hinds

[57] ABSTRACT

A folding table (10) is pivotally mounted to a vertical support (12) by a pair of longer arms (16) and two pairs of shorter arms (18), so that it can swing from a horizontal position to a vertical position against the support. A ground engaging leg (30) of adjustable length is hinged at (32) to the outer end of the table and can be swung up under the table when the table is to be folded away. The shorter arms (18) lie lengthwise in channel brackets (24) when the table is extended, thereby giving the table better lateral support. Adjustable stops (28) engage the underside of the table when extended.

4 Claims, 2 Drawing Figures

FIG. 1
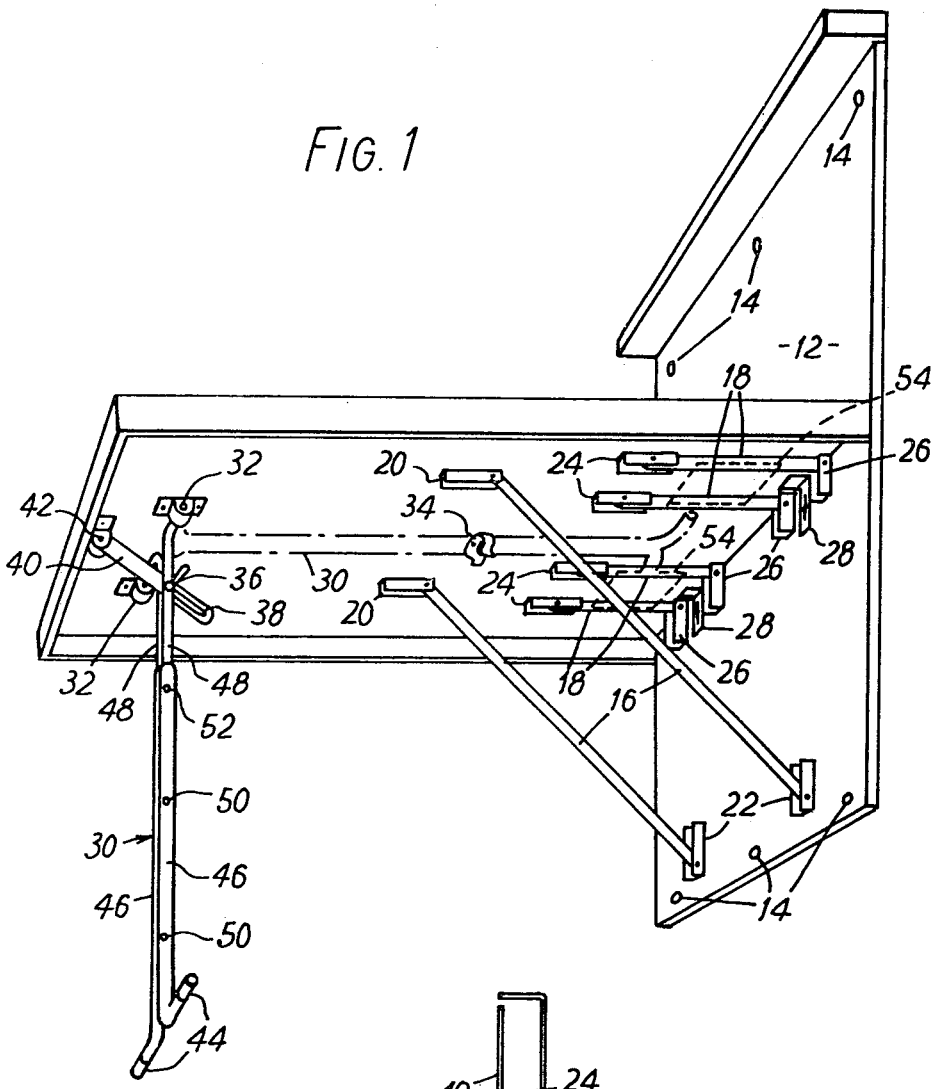
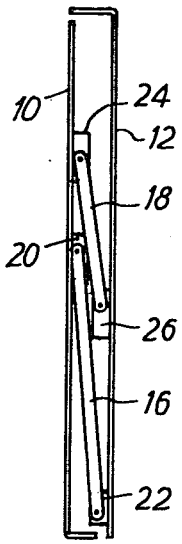
FIG. 2

FOLDING FURNITURE

FIELD OF THE INVENTION

This invention relates to folding furniture, and is especially applicable to furniture such as folding tables.

BACKGROUND OF THE INVENTION

In my U.K. Pat. No. 1,367,621 I described a folding table hingedly mounted at one of its longer sides to a vertical support by means of a linkage comprising longer and shorter arms each hinged at one end to the underside of the table and at the other end to the vertical support, and catch means for locking the table in the extended condition. My U.K. Pat. No. 1,372,820 described a folding bed, similarly mounted at one longer side to a vertical support. A ladder was detachably secured to the outer edge of the bed. However, the longer arms were pivoted to the underside of the bed nearer its outer edge, so that the bed was in fact normally stable in the extended condition, the ladder serving to provide access to the bed and keep the bed stable while the user is climbing in or out. The present invention is concerned with folding furniture, such as a table, similarly mounted to a vertical support, but in this case at its shorter edge. Such an arrangement takes up less wall width than when mounted at its longer edge, but has the disadvantage of being relatively less stable in various ways. The longer arms cannot conveniently be hinged near the outer edge of the table so it is unlikely to be normally stable in use unless it is locked in the extended condition. Even if locked against folding, a major problem with a table mounted at its shorter edge is lack of lateral stability, i.e. the free end is easily knocked sideways, with obvious disadvantages in use. Such would be the case with a folding table constructed along the lines of the ironing board in U.K. Pat. No. 945,429.

SUMMARY OF THE PRESENT INVENTION

The present invention provides an article of folding furniture, such as a table, in which the outer end is in use supported by a retractable and vertically adjustable leg hinged to the free end of the folding leaf. Thus, contrary to existing folding furniture of the type mounted by longer and shorter arms, where the leaf is normally stable in use, or is locked in the extended condition by means associated with the arms or the inner end of the leaf, the leaf of the present invention is supported in the extended condition by a leg at its outer end, which additionally gives a degree of lateral support for the free end. This lateral support can be further enhanced by employing more than two shorter arms, or by employing shorter arms whose hinges are broad in comparison with those of the longer arms. These and other features will be apparent from the following description of a particular embodiment.

BRIEF DESCRIPTION OF THE DRAWINGS, AND DESCRIPTION OF SPECIFIC EMBODIMENT

In the drawings:

FIG. 1 shows a perspective view from below of a table embodying the invention and in the extended condition, and FIG. 2 shows diagrammatically a side cross-sectional view of the table in the collapsed condition.

Referring to the drawings, the table comprises a rectangular leaf 10 which is mounted at one shorter end to a mounting board 12 which is adapted, for example, by holes 14 to take screws, for mounting to the wall or other vertical surface in a room at an appropriate height above the floor. The table leaf is pivotally mounted to the board by means of a pair of longer arms 16 and four shorter arms 18, so that the table can be swung between a horizontal extended position, as shown in FIG. 1, and a collapsed vertical position where it lies face-to-face with the mounting board 12, as shown in FIG. 2. Each of the arms 16,18 is pivoted at one end to the underside of the table and at the other end to the mounting board. The longer arms are pivoted to the table by means of brackets 20 and to the mounting board by means of brackets 22, while the shorter arms 18 are pivoted to the table by means of brackets 24 and to the mounting board by means of brackets 26. The brackets are of channel cross-section, pivot pins of the arms passing between the walls of the channels, and screws for securing the brackets to the table or mounting board passing through apertures in the base of the channels. The brackets 20 for the longer arms are further from the mounting board than the brackets 24 for the shorter arms, and the brackets 22 of the longer arms are at a lower position on the mounting board than the brackets 26 of the shorter arms. Brackets 24,26 are arranged so that when the table is at right angles to the mounting board the shorter arms 18 lie adjacent the undersurface of the table leaf and substantially parallel thereto, as shown in FIG. 1. It will be seen that the channels are somewhat elongate, and this is particularly true of the channels 24, since in the extended condition of the table leaf the shorter arms 18 lie along the channels 24 and, being a close fit within the channels, are laterally located thereby, thus providing support for the table against lateral rocking movement. It is preferred that the arms are of circular cross-section, so that they can be a close fit within the channels, their curved outer surfaces assisting in their smooth entry into the channels in those positions in which they are caused to lie lengthwise along the channels. It will be apparent that in the retracted condition of the table, as shown in FIG. 2, all the arms will lie somewhat lengthwise along the channel shaped mounting brackets.

With the shorter arms lying adjacent the undersurface of the table leaf in the extended condition, they or their brackets 26 can provide a stop limiting the pivotal movement of the table leaf at the extended position at right angles to the mounting board. However, since the mounting board may not be perfectly vertical, it is preferred to provide separate stop means in the form of L-shaped brackets 28, the longer arms of which are slotted and secured by screws to the mounting board between the brackets 26, the shorter arms of the brackets 28 projecting to engage the underside of the table leaf when in the extended condition. By slackening the securing screws for the brackets 28, these brackets can be moved up and down so as to limit the movement of the table leaf. By this means, the table leaf can be made perfectly level in its extended condition.

The end of the table remote from the mounting board has a leg 30 pivotally mounted at 32 to its undersurface so that it can be swung from an operative position as shown in full lines to a retracted inoperative position shown in dot-dash lines. In the operative position it depends from the table leaf for engagement with the floor, thereby maintaining the table leaf in the extended condition. In the inoperative position it is held by a spring clip 34 on the underside of the table leaf. The table leg is held in the operative position by means of a screw 36 which engages slidably in a slot 38 in an arm 40 which is pivoted at one end 42 to the underside of the table. Screw 36 is tightened when the leg is fully extended, and is released when it is desired to retract the leg.

As can be seen from FIG. 1, the leg 30 is constructed from two sets of tubes, the lower ends of which are turned mutually outwardly to form feet 44. Each set consists of a lower tube 46 and an upper tube 48 which is a sliding fit within the respective lower tube 46. By this means the length of the leg can be telescopically adjusted to suit the height of the table. The lower tubes are permanently secured together by bolts 50. The lower tubes 46 have apertures near their upper ends to take screws 52 which secure the upper tubes within the lower tubes when the leg has been adjusted to the desired length. This is done after the stops 28 have been set to locate the table leaf in a horizontal plane. With the table leaf in this condition the leg is telescopically extended until the feet engage the floor, and then the screws 52 are inserted and tightened.

When the table is collapsed, it lies face-to-face with the mounting board 12, which suitably has the same area as the table leaf and is arranged so that the table leaf and mounting board will be coincident in this collapsed condition, thereby presenting a neat appearance. The invention is especially applicable to tables or the like which have a longer dimension in one direction than in the other and which are to be hingedly mounted to the upright support at one of the shorter edges. The arrangement of the present invention gives suitable stability to such a structure. Although the illustrated embodiment has four shorter arms, only a pair of such arms is essential. However, provision of more than two such arms gives added stability against lateral rocking of the table in the extended condition. This can be further improved by rigidly interconnecting adjacent pairs of the shorter arms, for example by means of metal plates 54, thereby providing in effect just two shorter arms for the table, these arms having substantial width. It is this increased effective width at the hinges of the shorter arms which provide the improved stability. Instead of rigidly interconnecting adjacent pairs of shorter arms in this way, a single pair of shorter arms, each of substantial width, could be provided, for example fabricated from sheet metal of shallow channel cross-section. Further stability can be provided for the table in the extended position, for example by downwardly opening channel elements secured to the underside of the table to receive the arms 18 intermediate their ends when the table is extended, or by interengagement between interfitting elements on the inner end of the table and on the arms 18 or the support 12, so that the table is in effect locked against lateral movement.

I claim:

1. An improved article of furniture of the kind which includes an elongate leaf, which is normally used in an extended condition in a horizontal plane, pivotally mounted or adapted for pivotal mounting to an upright support at one end of the leaf by a linkage comprising longer and shorter arms pivotally attached at one end to the leaf at respectively outer and inner positions with respect to the upright support, and pivotally attached or adapted for pivotal attachment at their other ends to respectively lower and upper positions on the upright support so that the leaf may be hinged between the extended condition and a collapsed condition in a vertical plane alongside said upright support; wherein the improvement comprises a leg hinged to the other end of the leaf remote from said upright support so that it can be swung between an inoperative position substantially flat against the leaf which allows the leaf to be moved into the collapsed condition and an operative position in which is depends from the leaf for engagement with the floor so as to support said other end of the leaf and maintain it in the extended condition, the leg having provision for adjustment of its length to match the height at which the leaf is supported at said one end, two pairs of said shorter arms being provided in parallel, the arms of each pair being spaced apart and unconnected with each other, at least the outer arm of each pair lying laterally outwardly of the longer arms, and channel elements on the underside of the leaf arranged to receive lengthwise the shorter arms when the leaf is in the extended condition, the shorter arms being close fit within the channels so as to be laterally located thereby and provide lateral support for the leaf, said shorter arms being pivotally connected at their ends to channel members so that each shorter arm is received lengthwise in one or more said channels when the leaf is in either the extended or the collapsed condition.

2. An article of furniture according to claim 1 wherein the shorter arms extend substantially parallel to the underside of the leaf when the leaf is in the extended condition.

3. An article of furniture according to claim 1 wherein the arms are pivotally connected at their ends remote from their connection with the leaf to a mounting member which is adapted for mounting to a wall or the like fixed support.

4. An article of furniture according to claim 3 wherein at least one adjustable stop element is provided on the mounting member to be engageable by the adjacent end of the leaf when in the extended condition, whereby the leaf can be levelled by adjustment of the stop member prior to adjustment of the leg.

* * * * *